US009646790B2

(12) United States Patent
Rho

(10) Patent No.: US 9,646,790 B2
(45) Date of Patent: May 9, 2017

(54) CROSSBAR STRUCTURE OF ELECTROMAGNETIC CONTACTOR

(71) Applicant: LSIS CO., LTD., Anyang-si, Gyeonggi-do (KR)

(72) Inventor: Dong Chae Rho, Gwangju (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/849,397

(22) Filed: Sep. 9, 2015

(65) Prior Publication Data

US 2016/0126042 A1 May 5, 2016

(30) Foreign Application Priority Data

Oct. 31, 2014 (KR) ..... 10-2014-0150531

(51) Int. Cl.

| | |
|---|---|
| ***H01H 67/02*** | (2006.01) |
| ***H01H 50/14*** | (2006.01) |
| ***H01H 1/20*** | (2006.01) |
| ***H01H 1/50*** | (2006.01) |
| ***H01H 50/04*** | (2006.01) |
| ***H01H 50/54*** | (2006.01) |

(52) U.S. Cl.

CPC ..... *H01H 50/14* (2013.01); *H01H 1/2008* (2013.01); *H01H 1/50* (2013.01); *H01H 50/045* (2013.01); *H01H 50/546* (2013.01); *H01H 2001/508* (2013.01)

(58) Field of Classification Search

CPC ..... H01H 50/14; H01H 50/546; H01H 50/56; H01H 50/58; H01H 50/60; H01H 50/641–50/66; H01H 1/64

USPC ..... 335/131

See application file for complete search history.

(56) References Cited

U.S. PATENT DOCUMENTS 2,532,305 A 12/1950 Heller
2,815,420 A 12/1957 Moyer
(Continued)

FOREIGN PATENT DOCUMENTS

DE 102007015794 10/2008
EP 2515317 10/2012
(Continued)

OTHER PUBLICATIONS

European Patent Office Application Serial No. 15186173.9, Search Report dated Apr. 25, 2016, 8 pages.

*Primary Examiner* — Shawki S Ismail
*Assistant Examiner* — Lisa Homza
(74) *Attorney, Agent, or Firm* — Lee, Hong, Degerman, Kang & Waimey

(57) ABSTRACT

A crossbar structure of an electromagnetic contactor is provided, specifically, a crossbar structure of an electromagnetic contactor in which consistent performance is attained by preventing a moving mount from being flipped. The electromagnetic contactor includes a crossbar configured to move up and down and a moving contact point disposed on an installation groove, which is formed on the crossbar in a vertical direction, and brought in contact with or separated from a fixed contact point. The installation groove includes an insertion part into which the moving contact point is inserted and assembled and an operating part closely formed enough to prevent the moving contact point from being flipped when the moving contact point moves up and down.

5 Claims, 8 Drawing Sheets

(56) References Cited

U.S. PATENT DOCUMENTS 3,260,824 A * 7/1966 Schleicher ..... H01H 1/2083 200/243
3,324,431 A * 6/1967 Kussy ..... H01H 50/545 200/16 A
3,334,319 A * 8/1967 Herrmann ..... H01H 50/541 335/131
3,354,414 A * 11/1967 Fluder ..... H01H 50/28 335/124
3,671,891 A * 6/1972 Yushito ..... H01H 50/20 335/126
3,740,510 A * 6/1973 Grunert ..... H01H 50/546 200/289
3,796,978 A * 3/1974 Grunert ..... H01H 50/546 335/142
3,815,063 A * 6/1974 Grunert ..... H01H 50/60 200/50.35
3,873,952 A * 3/1975 Kondo ..... H01H 50/22 335/132
4,378,542 A * 3/1983 Feil ..... H01H 50/58 335/126
4,506,242 A * 3/1985 Karpe ..... H01H 50/323 335/119
4,565,986 A * 1/1986 Otsuka ..... H01H 50/546 335/131
4,565,987 A * 1/1986 Otsuka ..... H01H 50/546 335/131
4,720,761 A * 1/1988 Saletta ..... H01H 47/325 335/231
4,720,763 A * 1/1988 Bauer ..... H01H 47/325 335/231
4,728,810 A * 3/1988 Engel ..... H01H 47/002 307/108
4,739,293 A * 4/1988 Hurley ..... H01H 50/18 335/132
4,748,343 A * 5/1988 Engel ..... H01H 47/002 307/134
4,757,420 A * 7/1988 Saletta ..... G01R 19/25 324/77.11
4,833,565 A * 5/1989 Bauer ..... H01H 47/22 361/154
4,893,102 A * 1/1990 Bauer ..... H01H 50/305 335/132
4,931,757 A * 6/1990 Lemmer ..... H01H 89/06 335/131
4,947,146 A * 8/1990 Ichimura ..... H01H 51/2209 335/131
4,980,794 A * 12/1990 Engel ..... G01R 15/183 318/474
5,014,027 A * 5/1991 Ootsuka ..... H01H 50/38 333/132
5,021,760 A * 6/1991 Krubsack ..... H01H 50/20 335/196
5,059,930 A * 10/1991 Ootsuka ..... H01H 50/443 335/131
5,075,660 A * 12/1991 Ootsuka ..... H01H 50/643 335/131
5,081,436 A * 1/1992 Nishi ..... H01H 50/021 335/131
5,103,199 A * 4/1992 Ootsuka ..... H01H 50/323 335/133
5,541,561 A * 7/1996 Grunert ..... H01H 9/42 335/132
5,815,058 A * 9/1998 Gizaw ..... H01H 1/54 218/22
5,844,457 A * 12/1998 Eckroth ..... H01H 50/64 200/241
5,886,602 A * 3/1999 Burel ..... H01H 1/2008 200/243
5,959,517 A * 9/1999 Wieloch ..... H01H 81/04 218/22
6,111,488 A * 8/2000 Nakamura ..... H01H 50/045 335/132
6,297,717 B1 * 10/2001 Heckenkamp ..... H01H 50/22 335/132
6,377,143 B1 * 4/2002 Zhou ..... H01H 50/546 218/154
7,057,311 B1 * 6/2006 Zhou ..... H01H 9/563 307/126
7,091,805 B2 * 8/2006 Kawahara ..... H01H 50/546 335/130
7,598,831 B2 * 10/2009 Braun ..... H01H 1/20 335/131
8,212,638 B2 * 7/2012 Pandey ..... H01H 50/163 335/131
8,274,346 B2 * 9/2012 Takaya ..... H01H 50/045 335/127
8,289,111 B2 * 10/2012 Naka ..... H01H 50/16 335/131
8,324,993 B2 * 12/2012 Naka ..... H01H 50/045 335/132
8,324,994 B2 * 12/2012 Naka ..... H01H 50/323 335/132
8,653,916 B2 * 2/2014 Naka ..... H01H 50/30 335/131
2004/0169976 A1 * 9/2004 Zhou ..... H01H 9/563 361/93.1
2005/0013085 A1 * 1/2005 Kinsella ..... H01H 9/40 361/162
2005/0073787 A1 * 4/2005 Zhou ..... H01H 50/546 361/94
2005/0122085 A1 * 6/2005 Kinsella ..... H03K 19/17728 323/237
2006/0125581 A1 * 6/2006 Ohkubo ..... H01H 50/34 335/132
2006/0274459 A1 * 12/2006 Zhou ..... H01H 50/546 361/23
2013/0154775 A1 * 6/2013 Choi ..... H01H 36/00 335/205
2015/0002247 A1 * 1/2015 Rho ..... H01H 50/023 335/133
2016/0079021 A1 * 3/2016 De Barros Albuquerque ..... H01H 50/54 335/202
2016/0126042 A1 * 5/2016 Rho ..... H01H 1/2008 335/127

FOREIGN PATENT DOCUMENTS

KR 20-2000-0006970 4/2000
KR 10-2011-0062101 6/2011

* cited by examiner

CROSSBAR STRUCTURE OF ELECTROMAGNETIC CONTACTOR

CROSS-REFERENCE TO RELATED APPLICATION

Pursuant to 35 U.S.C. §119(a), this application claims the benefit of earlier filing date and right of priority to Korean Application No. 10-2014-0150531, filed on Oct. 31, 2014, the contents of which is incorporated by reference herein in its entirety.

BACKGROUND OF THE INVENTION

1. Field of the Invention

The present invention relates to a crossbar structure of an electromagnetic contactor, and more particularly, to a crossbar structure of an electromagnetic contactor in which consistent performance is maintained by preventing a moving mount from being flipped.

2. Background of the Invention

An electromagnetic contactor is a kind of electronic circuit switching device for transferring mechanical driving and electric current signals using electromagnetic principles and is disposed on various kinds of industrial equipment, machines, and vehicles.

First, the configuration and operation of an electromagnetic contactor according to the related art will be schematically described. FIG. 1 is a front view of a crossbar cross-sectional perspective view of an electromagnetic contactor according to the related art, FIG. 2 is a front view of a crossbar assembly of an electromagnetic contactor according to the related art, and FIG. 3 shows a state in a moving contact point is flipped.

Viewing the electromagnetic contactor according to the related art, an external appearance of the electromagnetic contactor is formed by upper and lower frames 1 and 2, and a plurality of fixed contact points 3 connected with a power source terminal or load terminal of an electric circuit are disposed on the upper frame 1.

A bobbin coil 4 is disposed on a lower portion of an internal space formed by the upper and lower frames 1 and 2 and configured to generate a magnetic force when power is applied. A fixed core 5 is disposed below the bobbin coil 4 and magnetized when the bobbin coil 4 generates a magnetic force. A moving core 6 is disposed above the fixed core 5 and configured to move up or down depending on whether the magnetic force is generated or terminated. A return spring 7 is disposed between the bobbin coil 4 and the moving core 6 and configured to provide an elastic force to the moving core 6.

In addition, a crossbar 8 is disposed above the moving core 6 and configured to move up or down along with the moving core, and moving contact points 9 are disposed on the crossbar and brought in electrical contact with or electrically separated from the fixed contact points 3. A contact spring 10 is disposed to provide a contact pressure force to each of the moving contact points.

In the electronic contactor having the above-described configuration, when an electric current is applied to the bobbin coil 4, the bobbin coil 4 is excited, and thus the fixed core 5 disposed below the bobbin coil 4 is magnetized. Due to a magnetic force of the magnetized fixed core 5, the moving core 6 disposed above the fixed core 5 is affected by an attractive force to moves down toward the fixed core 5, and also the crossbar 8 coupled with the moving core 6 moves down.

Thus, the moving contact point 9 coupled with the crossbar 8 is brought in contact with the fixed contact point 3 that is fixedly disposed on the upper frame 1.

On the contrary, when the magnetic force of the bobbin coil 4 is terminated, the attractive force that has attracted the moving core 6 disappears. Thus, the moving core 6 is separated from the fixed core 5 to move up to its original position due to a restoring force of the return spring 7.

However, as shown in FIG. 3, the moving contact point 9 of the conventional crossbar 8 is often flipped by its repetitive use or an external shock. This may cause serious problems such as failure in application of electric currents, fusion of contact points, and damage to load equipment.

SUMMARY OF THE INVENTION

Therefore, an aspect of the detailed description is to provide a crossbar structure of an electromagnetic contactor in which consistent performance is made by preventing a moving contact point from being flipped.

To achieve these and other advantages and in accordance with the purpose of this specification, as embodied and broadly described herein, there is provided To achieve these and other advantages and in accordance with the purpose of the present invention, as embodied and broadly described herein, there is provided a crossbar structure of an electromagnetic contactor, in which the electromagnetic contactor includes a crossbar configured to move up and down and a moving contact point disposed on an installation groove, which is formed on the crossbar in a vertical direction, and brought in contact with or separated from a fixed contact point, and in which the installation groove includes an insertion part into which the moving contact point is inserted and assembled and an operating part closely formed enough to prevent the moving contact point from being flipped when the moving contact point moves up and down.

An installation mount for mounting the moving contact point may be provided at both sides of the installation groove.

A rib may be formed in the operating part to protrude from a side wall of the crossbar along a length direction.

An upper portion of the rib may be formed as an inclined surface.

The moving contact point may include contact point parts disposed at both sides, a central part formed at a level lower than the contact point parts, and connection parts formed between the central part and the contact point parts.

The central portion may have a length equal to or greater than a width of the rib.

A vertical surface of the connection part may have a diagonal length greater than a width of the insertion part.

A cross-section of the central portion may have a diagonal length greater than an inner width of the operating portion.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, exemplary embodiments of the present invention will be described in detail with reference to the accompanying drawings. Embodiments may, however, be embodied in many different forms and should not be construed as being limited to the embodiments set forth herein; rather, these embodiments are provided so that this disclosure will be thorough and complete, and will fully convey the concept of embodiments to those skilled in the art.

Figure 1:
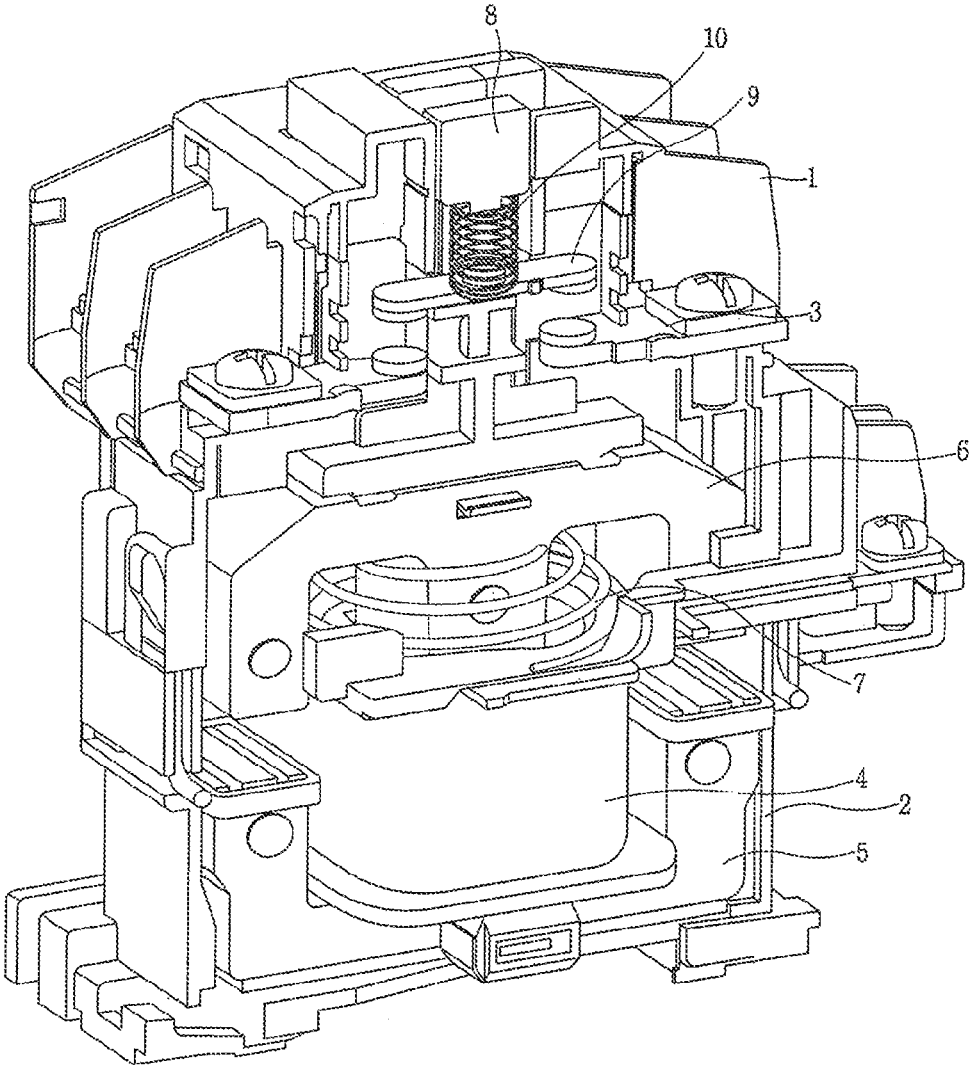
FIG. 1 Prior Art
FIG. 1 is a structure diagram of an electromagnetic contactor according to the related art.
Figure 2:
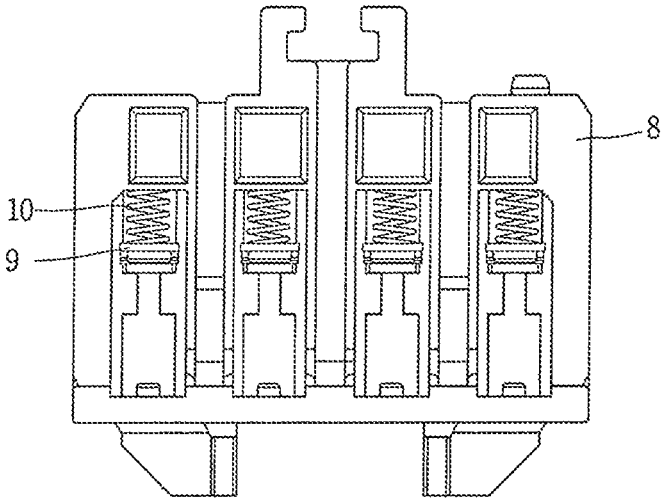
FIG. 2 Prior Art
FIG. 2 is a front view of a crossbar applied to an electromagnetic contactor according to the related art.
Figure 3:
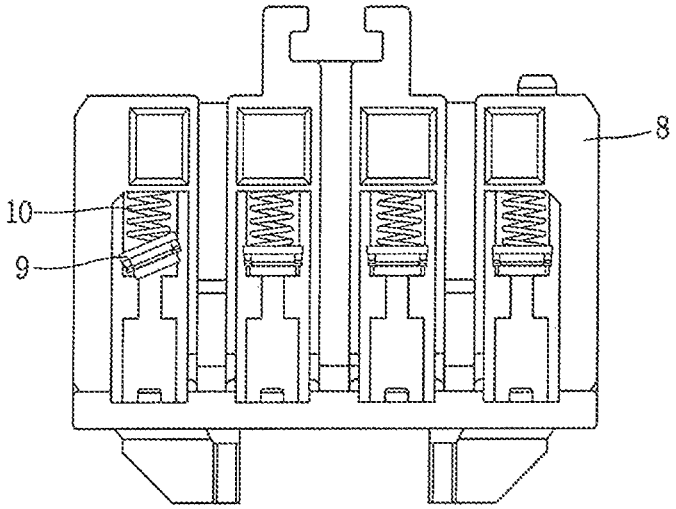
FIG. 3 Prior Art
FIG. 3 shows a state in which a moving contact point is flipped, in comparison with FIG. 2.
Figure 4:
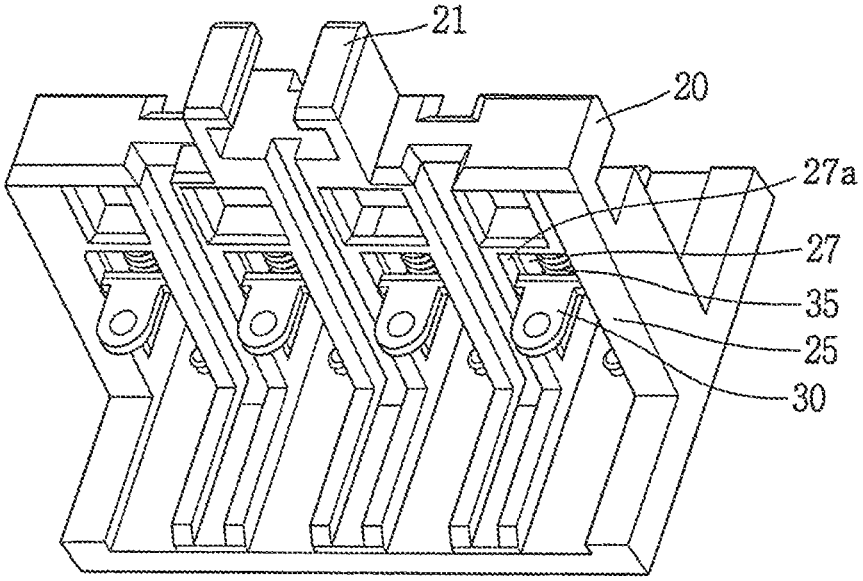
FIG. 4 is a perspective view of a crossbar applied to an electromagnetic contactor according to an embodiment of the present invention.
Figure 5:
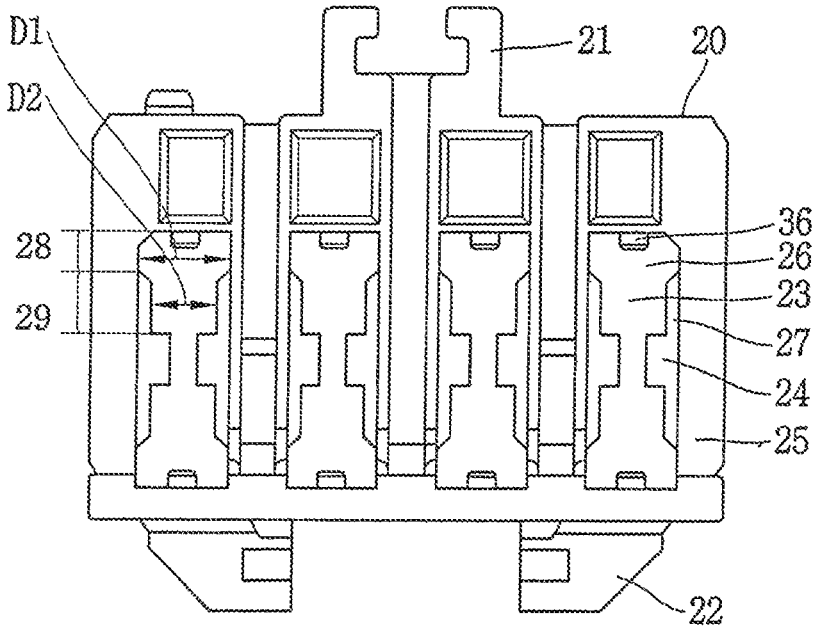
FIG. 5 is a front view of FIG. 4.
Figure 6:
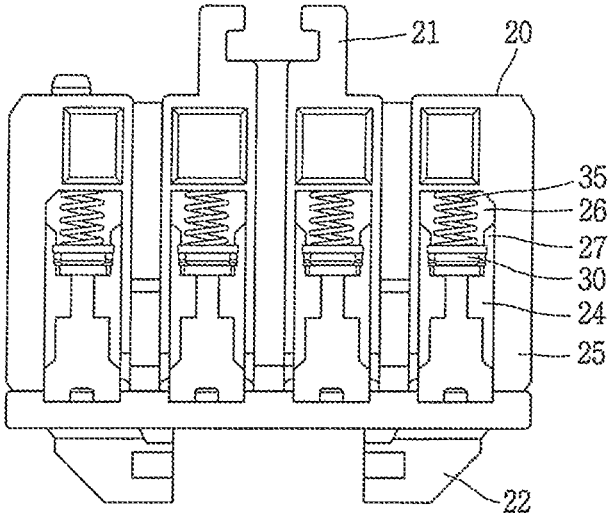
FIG. 6 shows a state in a moving contact point and a return spring are installed, in compared with FIG. 4.
Figure 7:
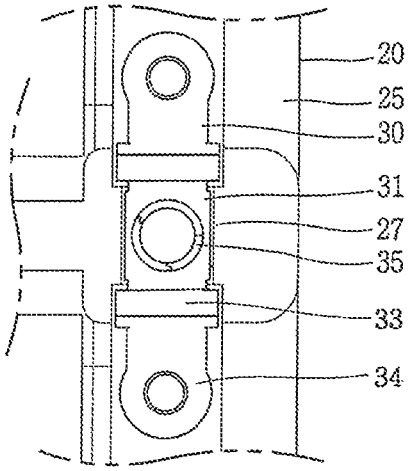
FIG. 7 is a partial plan view showing a state in which a moving contact point is disposed, in comparison with FIG. 5.
Figure 8:
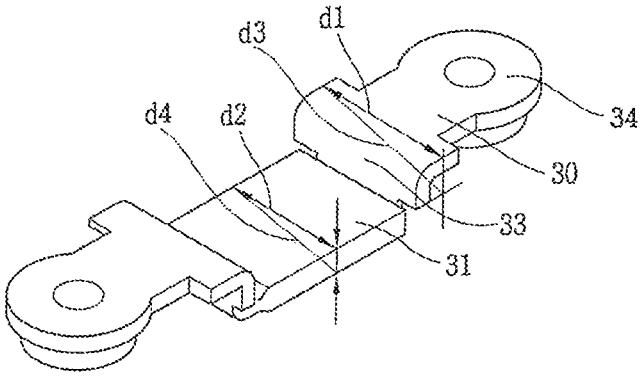
FIG. 8 is a perspective view of a moving contact point is applied to an electromagnetic contactor according to an embodiment of the present invention.

FIG. 4 is a perspective view of a crossbar applied to an electromagnetic contactor according to an embodiment of the present invention, and FIG. 5 is a front view of FIG. 4. FIG. 6 shows a state in a moving contact point and a return spring are installed, in comparison with FIG. 4. FIG. 7 is a partial plan view showing a state in which a moving contact point is installed, in comparison with FIG. 5. FIG. 8 is a perspective view of a moving contact point is applied to an electromagnetic contactor according to an embodiment of the present invention. A crossbar structure of an electromagnetic contactor according to an embodiment of the present invention will be described in detail with reference to drawings.

In a crossbar structure of an electromagnetic contactor according to an embodiment of the present invention, an electromagnetic contactor includes a crossbar 20 moving up and down and a moving contact point 30 disposed on an installation groove 23, which is formed on the crossbar 20 in a vertical direction, and brought in contact with or separated from a fixed contact point (not shown). The installation groove includes an insertion part into which the moving contact point is inserted and assembled and an operating part closely formed enough to prevent the moving contact point from being flipped when the moving contact point moves up and down.

Viewing the crossbar 20 from the side, the crossbar 20 is formed in the shape of an upside down T.

A contact part 21, on which an auxiliary relay may be disposed, may be provided above the crossbar 20.

A coupling part 22, with which a moving core (not shown) may be coupled, may be provided below the crossbar 20.

A plurality of installation groove 23, on which a plurality of moving contact points 30 may be disposed, may be formed on the crossbar 20. Each installation groove may be formed to be long in a vertical direction. The number of installation grooves 23 may be equal to the number of moving contact points 30. The number of moving contact points 30 may be equal to the number of phases. For example, on a condition that a three-phase circuit and a neutral electrode are included, the number of moving contact points 30 may be four.

An installation mount 24, on which the moving contact point 30 may be mounted, is provided on the installation groove 23. The installation mount 24 is formed to protrude from side walls 25 forming the installation groove 23. The installation mount 24 may be formed symmetrically on both of the side walls 25.

The insertion part 26 and the operating part 29 may be provided in an upper portion of the installation groove 23.

The insertion part 26 into which the moving contact point 30 may be inserted is provided in the upper portion of the installation groove 23. The insertion part 26 is a space into which the moving contact point 30 is inserted to be assembled. Here, the insertion part 26 may has a width D1 greater than a transverse width d1 of the moving contact point 30 (see FIGS. 5 and 8).

The operating part 29 is provided between the insertion part 26 and the installation mount 24. The operating part 29 is a space in which the moving contact point 30 is operated while the electromagnetic contactor is operated after the moving contact point 30 is assembled.

Here, ribs 27 may be formed on the operating part 29 to protrude from both the side walls 25 in a length direction. The ribs 27 may be formed symmetrically to protrude from both the side walls 25.

Here, the insertion part 29 may have an inner width D2 greater than a transverse width d2 of a central part of the moving contact point 30 (see FIGS. 5 and 8). However, the width difference is very small. That is, as shown in FIG. 7, the central part 31 of the moving contact point 30 is closely disposed on the rib 27. Accordingly, the moving contact point 30 moves up and down with respect to the crossbar 20 while being inserted into the rib 27 inside the operating part 29. Thus, the moving contact point 30 moves up and down along the rib 27 inside the operating part 29 without vibration. Here, the rib 27 serves to guide the vertical movement of the moving contact point 30.

An upper portion of the rib 27 may be formed as an inclined surface 27*a*. Thus, the moving contact point 30 inserted into the insertion part 26 is easily input to the operating part 29 along the inclined surface 27*a*.

A concave part 28 is formed on both sides of the rib 27. A connection part 33 of the moving contact point 30 to be described below is in contact with the concave part 28. Here, the concave part 28 may have a width D1 equal to a width of the insertion part 26.

A fixed protrusion 36 on which the contact spring 35 may be disposed may be provided on an upper portion of the installation groove 23.

The moving contact point 30 may be disposed over the installation mount 24. The contact spring 35 is provided between the moving contact point 30 and the installation groove 23 to provide an elastic force when the moving contact point 30 moves up. The crossbar 20 moves down to bring the moving contact point 30 in contact with a fixed contact point (not shown). Thus, an upward force is exerted on the moving contact point 30. In this case, the contact spring 35 is provided in order to enhance a contact force between the moving contact point 30 and the fixed contact point. Here, the contact spring 35 may have an external diameter substantially equal to the internal diameter of the operating part 29. This increase a contact pressure force and reduce a space in which the moving contact point 30 may be flipped.

The moving contact point 30 may include contact point parts 34 disposed at both sides, a central part 31 formed at a level lower than the contact point parts 34, and a connection part 33 formed between each contact point part 34 and the central part 31.

The central part 31 of the moving contact point 30 is formed at a level lower than the contact point parts 34 at both sides. The central part 31 may have a length substantially equal to a width of the rib 27. Thus, the moving contact point 30 is caught on the rib 27 to fail to fall out of the operating part 29 in a vertical direction.

The connection part 33 is formed between the central part 31 and the contact point part 34. The connection part 33 may be formed in the shape of "ㄱ". That is, the connection part 33 may include a vertical surface and a horizontal surface. The connection part 33 may has a width equal to or less than a width of the insertion part 26. The connection part 33 may has a width greater than a width of the central part 31 or contact point part 34. Here, the vertical surface of the connection part 33 has a diagonal length equal to the length represented as d3 in FIG. 8. Here, the vertical surface of the connection part 33 has a diagonal length greater than an inner width of the concave part 28 or insertion part 26. Thus, the moving contact point 30 maintains a stable posture without being flipped although a vibration or shock is applied during a vertical movement.

The operating part 29 has an inner width D2 less than a diagonal length d4 of a cross-section of the central part of the moving contact point 30. Thus, the central part of the moving contact point 30 cannot cause rotation of the operating part 29.

As a result, the moving contact point 30 may apply or block an electric current while stably moving up and down without being flipped inside the operating part 29.

With the crossbar structure of the electromagnetic contactor according to an embodiment of the present invention, the moving contact point may not be flipped, thus preventing failure in application of electric currents and damage to load equipment. Accordingly, it is possible to secure consistency in performance of a product and enhance durability of the product.

Although the present invention has been described with reference to exemplary embodiments thereof, it should be understood that numerous other modifications and variations can be made without departing from the spirit and scope of the present invention by those skilled in the art. It is obvious that the modifications and variations fall within the spirit and scope thereof.

What is claimed is:

1. An electromagnetic contactor including a crossbar structure, the electromagnetic contactor comprising:

a crossbar configured to move up and down; and a moving contact point located on an installation groove, the moving contact point formed on the crossbar in a vertical direction and brought in contact with or separated from a fixed contact point, wherein the installation groove comprises:

an insertion part into which the moving contact point is inserted and assembled; and an operating part that prevents the moving contact point from being flipped when the moving contact point moves, wherein the operating part comprises a rib that protrudes from a side wall of the crossbar along a length direction, wherein the moving contact point comprises contact point portions located at both sides, a central portion formed at a level lower than the contact point portions and connection portions formed between the central portion and the contact point portions, wherein a width of each connection portion is smaller than a width of the insertion part and larger than a width of the operating part, and wherein a width of the central portion is smaller than the width of the operating part.

2. The electromagnetic contactor of claim 1, further comprising an installation mount provided at both sides of the installation groove for mounting the moving contact point.

3. The electromagnetic contactor of claim 1, wherein an upper portion of the rib has an inclined surface.

4. The electromagnetic contactor of claim 1, wherein a vertical surface of each connection portion has a diagonal length greater than the width of the insertion part.

5. The electromagnetic contactor of claim 1, wherein a cross-section of the central portion has a diagonal length greater than an inner width of the operating part.

* * * * *